US006270434B1

(12) United States Patent
Shaw

(10) Patent No.: US 6,270,434 B1
(45) Date of Patent: Aug. 7, 2001

(54) GAME RACKET TO SHOW THE STATE OF THE BODY OF AN EXERCISER

(76) Inventor: Anthony Shaw, 21F-3, No. 218, Feng Chia Road, Taichung (TW)

( * ) Notice: Subject to any disclaimer, the term of this patent is extended or adjusted under 35 U.S.C. 154(b) by 0 days.

(21) Appl. No.: 09/503,328

(22) Filed: Feb. 14, 2000

(51) Int. Cl.[7] ..... A63B 69/38; A63B 71/06

(52) U.S. Cl. ..... 473/553; 473/549; 473/461

(58) Field of Search ..... 473/524, 518, 473/553, 549, 461, 463, 459, 464, 199, 221, 223, 151, 300, 202, 209, FOR 183, FOR 173, FOR 171

(56) References Cited

U.S. PATENT DOCUMENTS 4,367,752 * 1/1983 Jimenez et al. ..... 600/502
4,911,441 * 3/1990 Brunner ..... 473/461
5,542,676 * 8/1996 Howe, Jr. et al. ..... 473/202
5,681,993 * 10/1997 Heitman ..... 73/379.02
6,016,103 * 1/2000 Leavitt ..... 340/575
6,032,530 * 3/2000 Hock ..... 73/379.01

FOREIGN PATENT DOCUMENTS 200 02 202 * 5/2000 (DE) .
1405857 * 6/1988 (SU) ..... 473/FOR 183

* cited by examiner

*Primary Examiner*—Raleigh W. Chiu
(74) *Attorney, Agent, or Firm*—Browdy and Neimark

(57) ABSTRACT

A game racket is provided in the grip portion thereof with a sensor for detecting changes in body characteristic of a person engaging in exercise by using the game racket. The changes in body characteristic of the person are detected in the form of electronic signals, which are converted by the sensor into data. The data are exhibited by a display which is disposed in a predetermined position of the game racket. On the basis of the data, an exerciser may adjust the pace of the exercise in which the exerciser is engaged.

5 Claims, 3 Drawing Sheets

GAME RACKET TO SHOW THE STATE OF THE BODY OF AN EXERCISER

FIELD OF THE INVENTION

The present invention relates generally to a game racket, and more particularly to a game racket having means to show the body condition of an exerciser using the game racket.

BACKGROUND OF THE INVENTION

The exercise can bring about changes in the body physiology of a person engaging in the exercise. For this reason, the moderate exercise is often beneficial to the health of an exerciser. If the exercise is done excessively, the exercise becomes in itself hazardous to the health of the exerciser. The conventional game rackets are not provided with a device for monitoring the body condition of an exerciser. As a result, the exerciser is often unaware of the need to adjust the pace of exercise to minimize the risk of the danger resulting from the excessive exercise.

SUMMARY OF THE INVENTION

The primary objective of the present invention is to provide a game racket capable of monitoring the state of body of a person doing the exercise with the game racket.

In keeping with the principle of the present invention, the foregoing objective of the present invention is attained by a game racket comprising a frame and a handle. The handle is provided in the grip thereof with a sensor for detecting the changes in the body physiology of an exerciser doing the exercise by using the game racket. The data are exhibited in a display to remind the exerciser of the need to adjust the pace of the exercise.

DETAILED DESCRIPTION OF THE INVENTION

Figure 1:
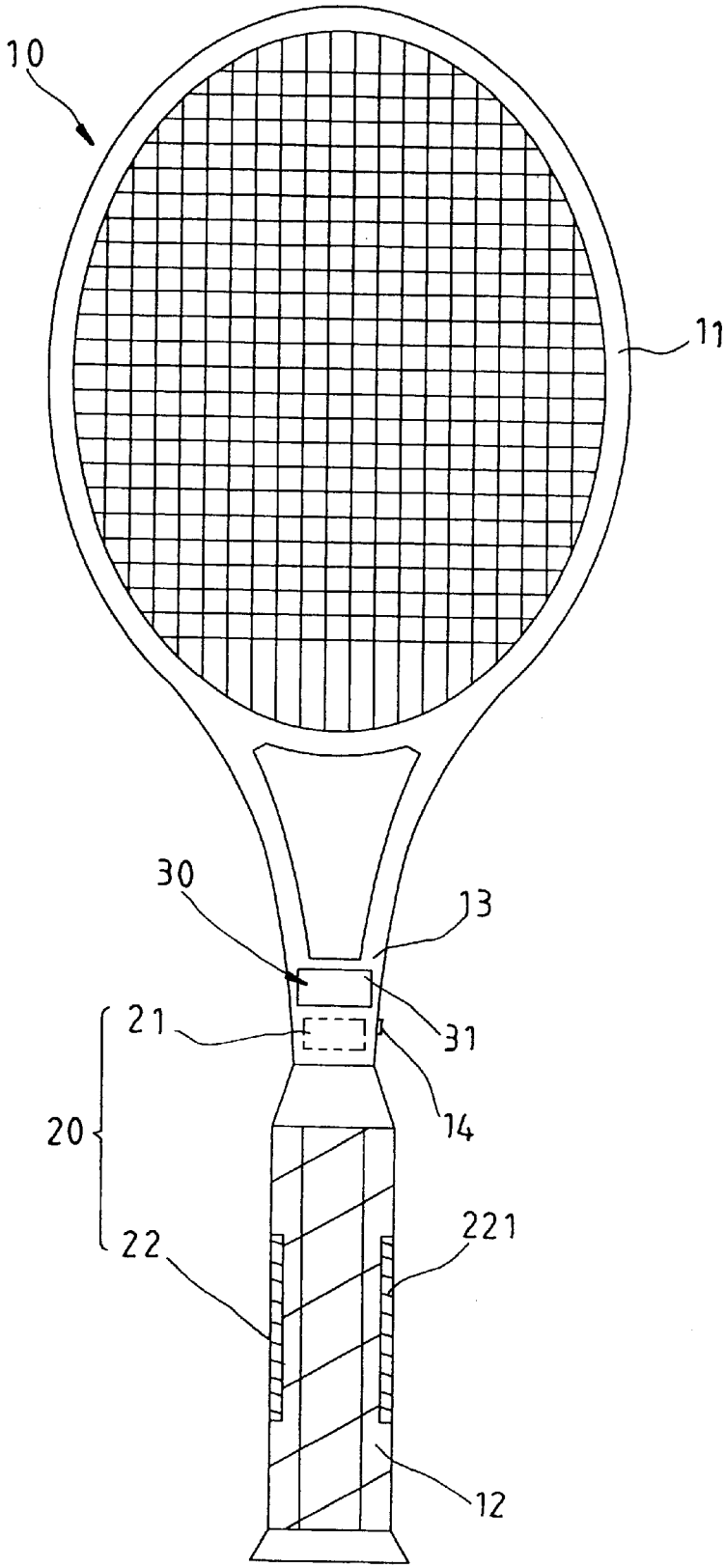
FIG. 1 shows a schematic perspective view of a first preferred embodiment of the present invention.

As shown in FIG. 1, a game racket 10 embodied in the present invention is a tennis racket 10, which is formed of a frame 11, a handle 12, and a neck 13 located between the frame 11 and the handle 12. The tennis racket 10 is provided in a predetermined position thereof with a selection switch 14 for entering the instruction as to the nature of the state of body to be monitored. The handle 12 is provided with a sensor 20. The neck 13 is provided with a display 30.

The sensor 20 comprises a control circuit board 21 and two sensing pieces 22 which are electrically connected with the control circuit board 21. The control circuit board 21 carries out the signal conversion, the data recognition, the program operation, etc. The control circuit board 21 is protected by a shock-absorbing body (not shown in the drawing). The control circuit board 21 is enclosed in the shock-absorbing body and is embedded in the interior of the portion located between the handle 12 and the neck 13. The sensing pieces 22 are wound around the outer surface of the grip portion of the handle 12 such that the sensing pieces 22 are in contact with the palm of a hand holding the handle 12.

In order to provide friction between the palm and the sensing pieces 22, the sensing pieces 22 are provided in the outer surface thereof with a skidproof layer 221.

The display 30 is inlaid in the neck 13 and is electrically connected with the control circuit board 21. The display 30 has a screen 31 on which the data computed by the control circuit board 21 are exhibited. The data are computed by the control circuit board 21 on the basis of the signals transmitted from the sensor 20. The data indicate the state of the body of a person doing exercise with the tennis racket 10. As a result, the person may depend on the data to adjust the pace of the exercise in which he or she is engaged.

In view of the sensing pieces 22 of the sensor 20 being in direct contact with the palm of a hand holding the handle 12 of the tennis racket 10, the changes in the body characteristics, such as heart beat or consumption of body fat, are detected by the sensing pieces 22 in the form of pulse variation or current impedance variation. The signals are then transmitted from the sensor 20 to the control circuit board 21 in which conversion, recognition and computation of the signals are carried out. The data computed by the control circuit board 21 are finally exhibited on the screen 31 of the display 30.

Figure 2:
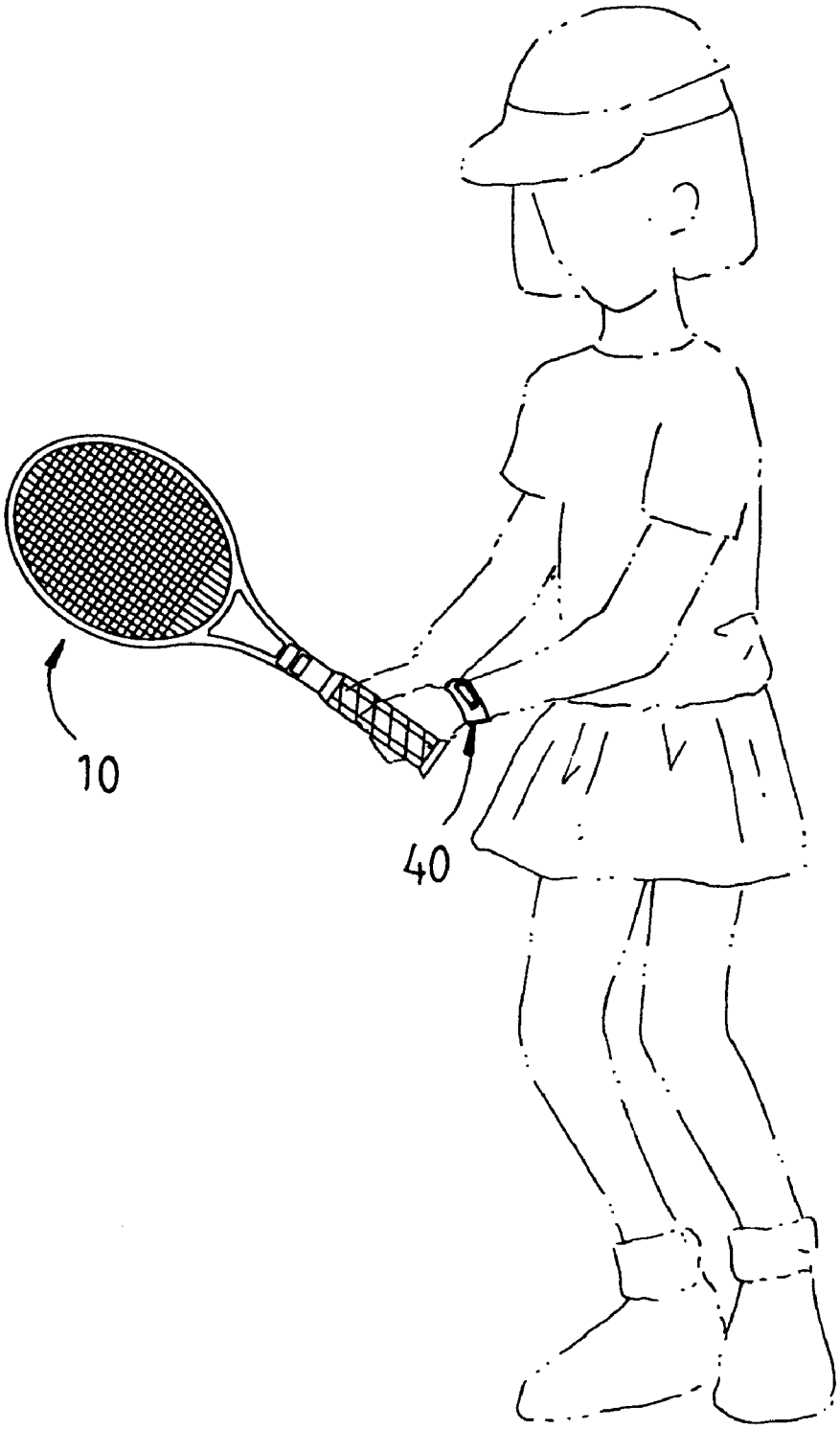
FIG. 2 shows a schematic view of a second preferred embodiment of the present invention in use.

As shown in FIG. 2, a display 40 of the second preferred embodiment of the present invention is worn around the wrist of a person engaging in the exercise by using the tennis racket 10 of the present invention. The signal transmission between the sensor 20 and the display 40 is attained by a transceiver.

Figure 3:
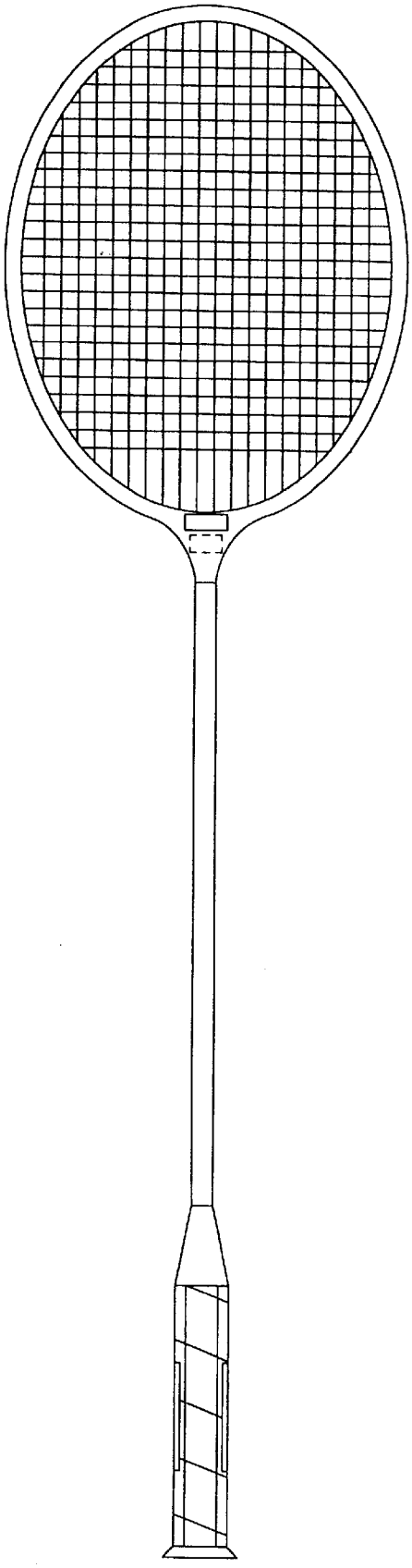
FIG. 3 shows a perspective view of a third preferred embodiment of the present invention.

In addition to the tennis racket, the technique of the present invention may be also employed in a badminton racket, as illustrated in FIG. 3.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A game racket comprising:

a frame;

a handle having a grip portion which is provided with a sensor for detecting changes in a body characteristic of a person engaging in an exercise by using said game racket whereby said sensor is provided with a means for converting electronic signals of changes in the body characteristic into data;

a display for exhibiting the data transmitted from said sensor; and further comprising a selection switch connected with said control circuit board for determining selectively the nature of the body characteristic to be monitored.

2. The game racket as defined in claim 1, wherein said display is located on a neck which is between said frame and said handle.

3. The game racket as defined in claim 1, wherein said sensor comprises a control circuit board and one or more sensing pieces electrically connected with said control circuit board which is disposed in the interior of a portion located between a neck of the frame and said handle whereby said sensing pieces are wound around the outer surface of said grip portion of said handle.

4. The game racket as defined in claim 3, wherein said sensing pieces are provided on an outer surface thereof with a skidproof layer attached thereto.

5. The game racket as defined in claim 1, wherein said display is worn around the wrist of a person engaging in exercise by using said game racket whereby said display exhibits the data transmitted from said sensor via a transceiver.

* * * * *